US005601096A

United States Patent [19]

Lin

[11] Patent Number: 5,601,096

[45] Date of Patent: Feb. 11, 1997

[54] ASHTRAY

[76] Inventor: Hsi H. Lin, P.O. Box 82-144, Taipei, Taiwan

[21] Appl. No.: 674,146

[22] Filed: Jul. 1, 1996

[51] Int. Cl.[6] ..... A24F 19/00

[52] U.S. Cl. ..... 131/240.1; 131/235.1

[58] Field of Search ..... 131/231, 235.1, 131/240.1, 241, 256; D27/102, 136, 138

[56] References Cited

U.S. PATENT DOCUMENTS

| | | | |
|---|---|---|---|
| D. 112,641 | 12/1938 | Lang | 131/240.1 X |
| D. 116,973 | 10/1939 | Kuhlman | 131/240.1 X |
| D. 152,656 | 2/1949 | Schwisow | 131/240.1 X |
| D. 155,083 | 9/1949 | Frank | 131/240.1 X |
| 2,638,905 | 5/1953 | Morrison | 131/240.1 X |
| 3,234,951 | 2/1966 | Schilling | 131/235.1 |

*Primary Examiner*—Jennifer Bahr

*Attorney, Agent, or Firm*—Alfred Lei

[57] ABSTRACT

An ashtray including a cylindrical center upright wall defining a cylindrical storage chamber and having a plurality of radial top dents, a cylindrical intermediate upright wall concentrically raised around the cylindrical center upright wall and defining with it an annular chamber and having a plurality of radial top dents corresponding to and below the elevation of the radial top dents of the cylindrical center upright wall, a cylindrical outer upright wall concentrically raised around the cylindrical intermediate upright wall and defining with it an annular chamber and having a plurality of radial top dents corresponding to and above the radial top dents of the cylindrical center upright wall and the cylindrical intermediate upright wall, and an outward flange raised around the periphery of the cylindrical outer upright wall and curving smoothly outwardly upwards, the cylindrical outer upright wall having a plurality of openings spaced around the periphery below the top dents thereof above the connecting area between the outward flange and the cylindrical outer upright wall.

2 Claims; 4 Drawing Sheets

ASHTRAY

BACKGROUND OF THE INVENTION

1. Field of the Invention

This invention relates to ashtrays, and relates more particularly to such an ashtray which prevents burning cigarettes from falling to the outside.

2. Description of the Prior Art

Regular ashtrays are designed in different shapes to attract people to buy. There are ashtrays having means to block up the smoke of disposed cigarette. However, few ashtrays can prohibit burning cigarettes from falling to the outside. In order to prohibit burning cigarette from falling to the outside, the size or depth of the ashtray must be relatively increased.

SUMMARY OF THE INVENTION

This invention relates to an improved ashtray.

According to one aspect of the present invention, the ashtray comprises a cylindrical center upright wall having a plurality of radial top dents for the resting of burning cigarettes, a cylindrical intermediate upright wall concentrically raised around the cylindrical center upright wall and defining with it an annular ash chamber and having a plurality of radial top dents corresponding to and below the elevation of the radial top dents of the cylindrical center upright wall for the resting of burning cigarettes, and a cylindrical outer upright wall concentrically raised around the cylindrical intermediate upright wall and defining with it an annular ash chamber and having a plurality of radial top dents corresponding to and above the radial top dents of the cylindrical center upright wall and the cylindrical intermediate upright wall for the resting of burning cigarette. According to another aspect of the present invention, the cylindrical outer upright wall has a plurality of openings spaced around the periphery below the top dents thereof above the connecting area of the outward flange, and an outward flange smoothly and radially curving outwardly upwards for guiding fallen cigarette butts to the inside of the outer annular chamber through the openings of the cylindrical outer upright wall. According to still another aspect of the present invention, the cylindrical center upright wall defines a cylindrical storage chamber adapted for keeping stationery materials.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
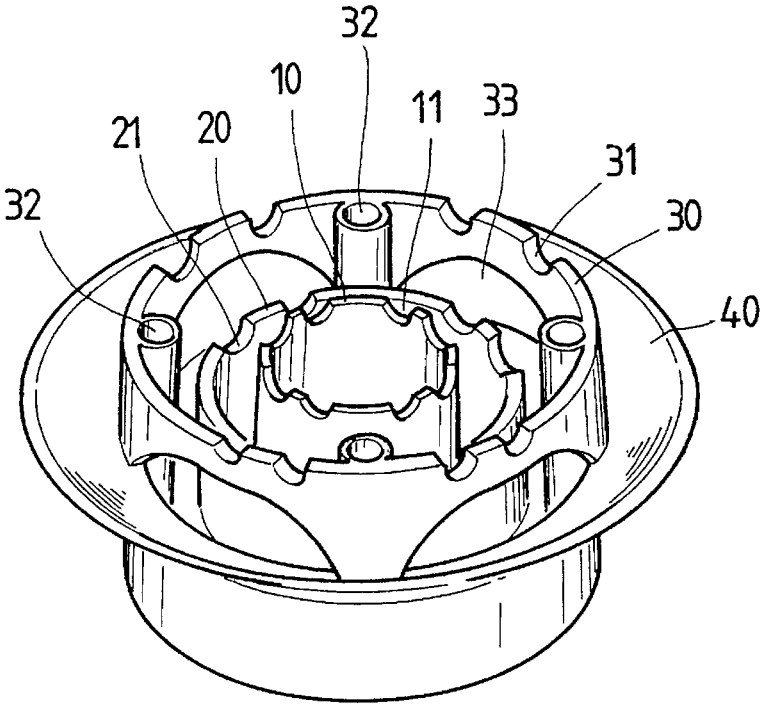
FIG. 1 is an elevational view of an ashtray according to the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
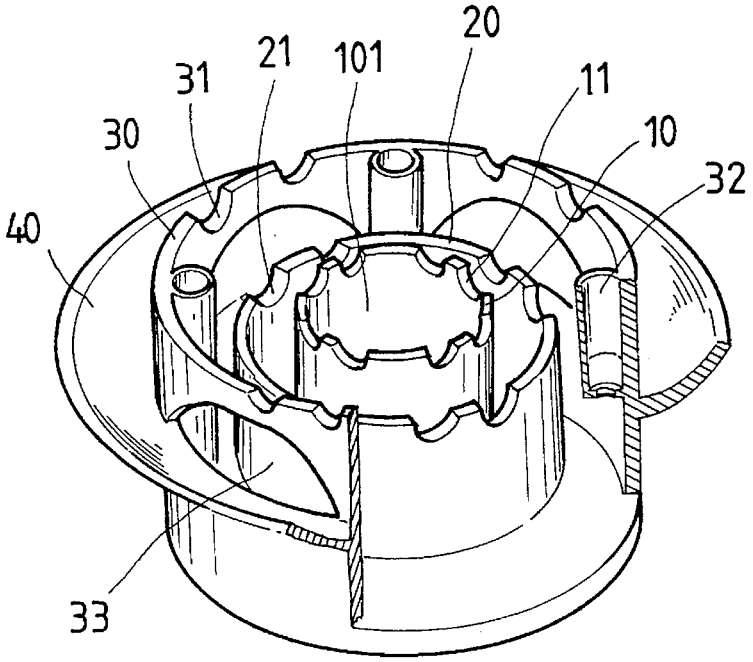
FIG. 2 is a cutaway of the ashtray shown in FIG. 1.
Figure 3:
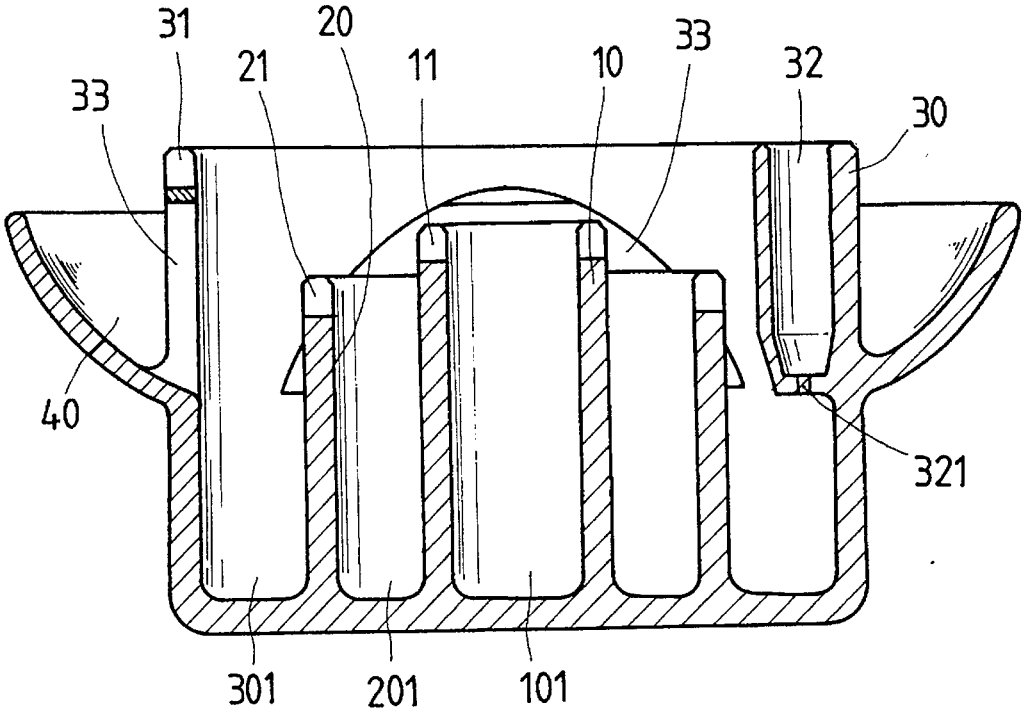
FIG. 3 is a sectional plain view of the ashtray shown in FIG. 1.

Referring to FIGS. 1, 2, and 3, an ashtray in accordance with the present invention comprises a cylindrical center upright wall 10, a cylindrical outer upright wall 30 raised around the cylindrical center upright wall 10, a cylindrical intermediate upright wall 20 concentrically spaced between the cylindrical center upright wall 10 and the cylindrical outer upright wall 30, and an outward flange 40 raised around the periphery of the cylindrical outer upright wall 30 and smoothly curving upwards. The cylindrical center upright wall 10 is taller than the cylindrical intermediate upright wall 20 but shorter than the cylindrical outer upright wall 30, having a plurality of radial top dents 11 for the resting of cigarettes and defining a cylindrical chamber 101. The cylindrical upright wall 20 defines with the cylindrical center upright wall 10 an annular chamber 201, and has a plurality of radial top dents 21 corresponding to the radial top dents 11 of the cylindrical center upright wall 10 for the resting of cigarettes. The cylindrical outer upright wall 30 defines with the cylindrical intermediate upright wall 20 an annular chamber 301, and has a plurality of radial top dents 31 corresponding to the radial top dents 11 of the cylindrical center upright wall 10 and the radial top dents 21 of the cylindrical intermediate upright wall 20 for the resting of cigarettes. The outward flange 40 curves smoothly upwardly outwards in the radial direction. The elevation of the topmost edge (the outer end) of the outward flange 40 is lower than the topmost edge of the cylindrical outer upright wall 30. The cylindrical outer upright wall 30 further comprises a plurality of openings 33 spaced around the periphery below the top dents 31 but above the connecting area of the outward flange 40. A plurality of cylindrical, top-opened smoke-extinguishing troughs 32 are raised from the inside wall of the cylindrical outer upright wall 30, and spaced from the bottom end of the chamber 301 at a distance. Into the smoke-extinguishing toughs 32 burning cigarettes can be inserted to extinguish the smoke. Each of the smoke-extinguishing troughs 32 has a small round hole 321 at the bottom through which cigarette ash drops to the inside of the chamber 301.

Figure 4A:
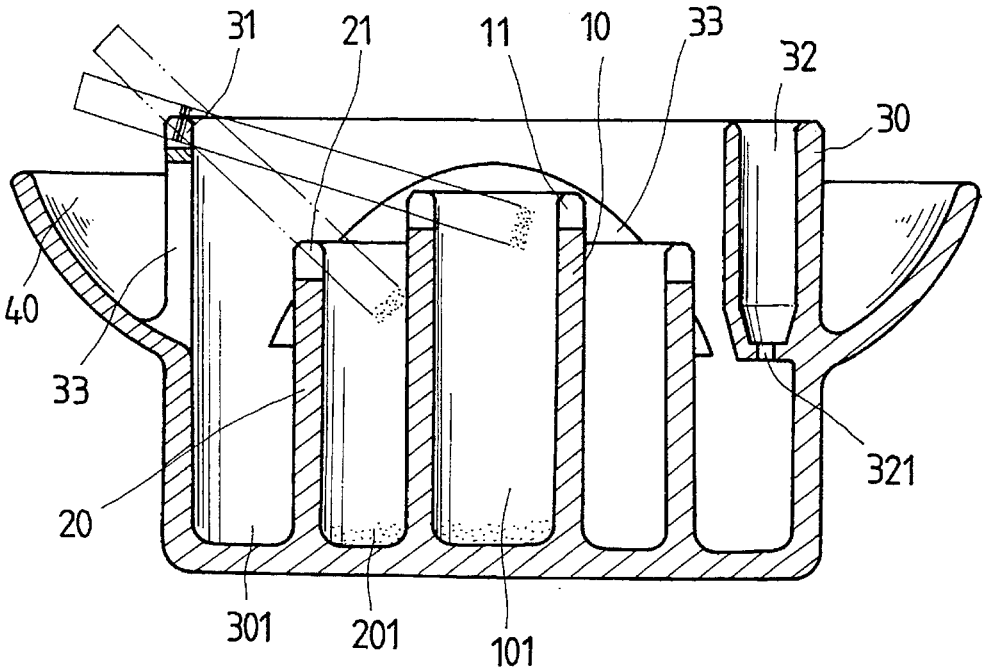
FIG. 4A is an applied view in section of the present invention, showing burning cigarettes rested in the top dents.
Figure 4B:
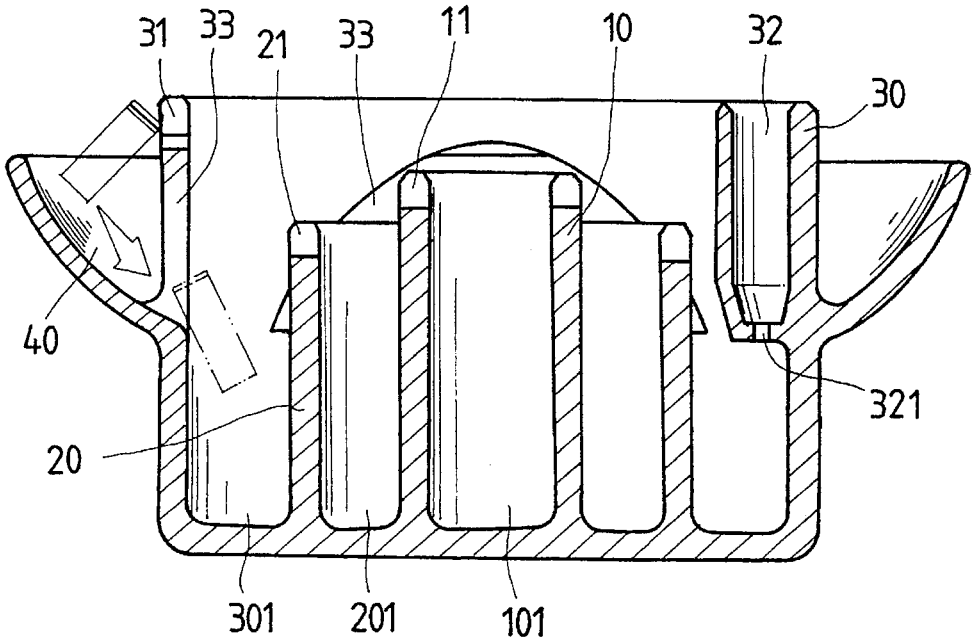
FIG. 4B shows the butt of a burnt-out cigarette fall to the outward flange.
Figure 5:
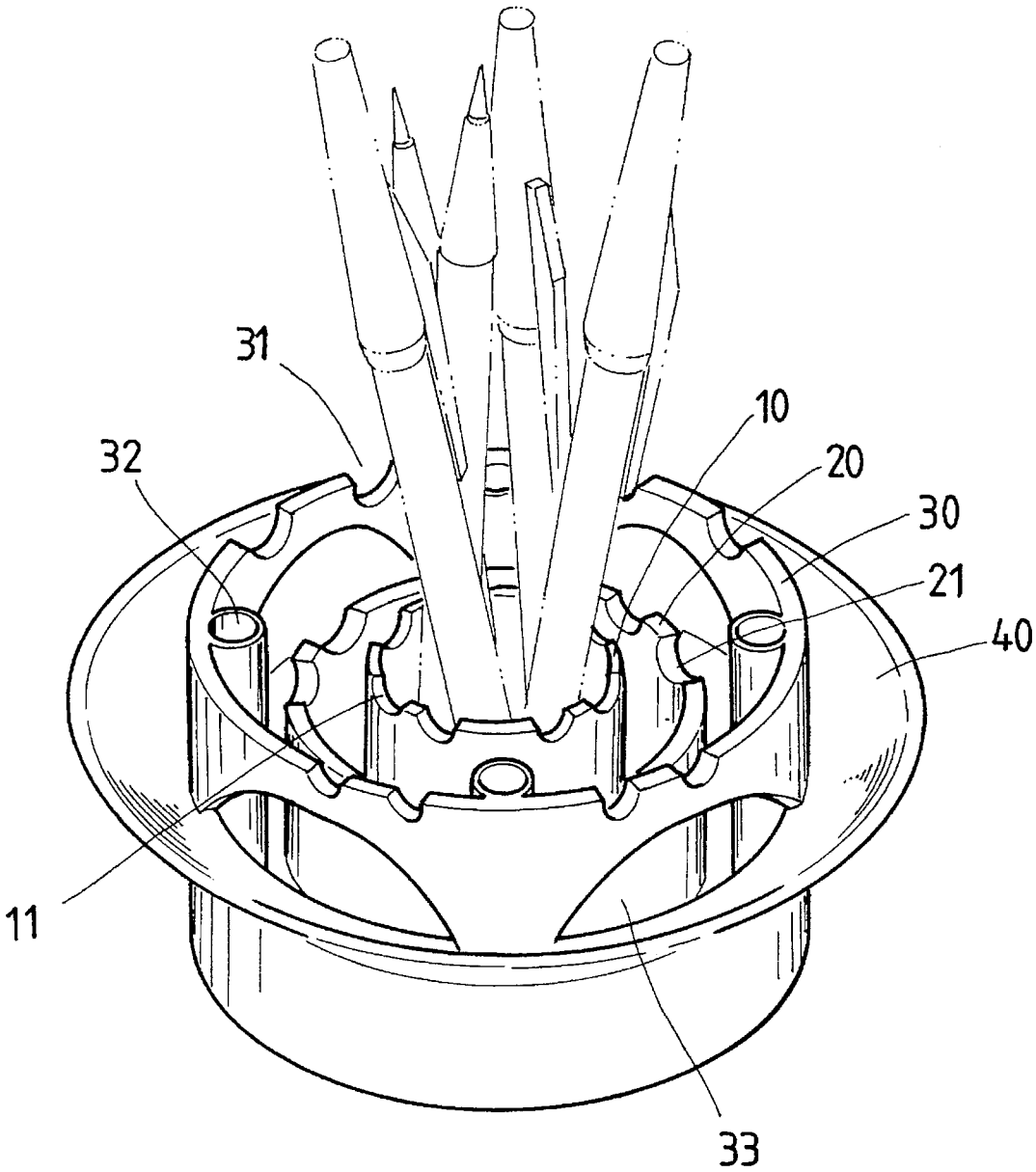
FIG. 5 is another applied view of the present invention, showing writing materials carried in the cylindrical chamber within the cylindrical center upright wall of the ashtray.

Referring to FIGS. 4A, 4B, and 5, burning cigarettes can be rested in the top dents 31 and 11 and supported between the cylindrical outer upright wall 30 and the cylindrical center upright wall 10, or rested in the top dents 31 and 21 and supported between the cylindrical outer upright wall 30 and the cylindrical intermediate upright wall 10 (see FIG. 4A). When the butt of a burnt-out cigarette drops from the top dents 31 of the cylindrical outer upright wall 30, it will fall to the outward flange 40, and then fall to the inside of the chamber 301 through one opening 30 of the cylindrical outer upright wall 30 (see FIG. 4B).

Referring to FIG. 5, the ashtray can also be used as a stationery rack for holding pens, rules, and other writing materials in the cylindrical chamber 101.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An ashtray comprising a cylindrical center upright wall defining a cylindrical storage chamber and having a plurality of radial top dents, a cylindrical intermediate upright wall concentrically raised around said cylindrical center upright wall and defining with it an annular chamber and having a plurality of radial top dents corresponding to and below the elevation of the radial top dents of said cylindrical center upright wall, a cylindrical outer upright wall concentrically raised around said cylindrical intermediate upright wall and defining with it an annular chamber and having a plurality of radial top dents corresponding to and above the radial top dents of said cylindrical center upright wall and said cylindrical intermediate upright wall, and an outward flange raised around the periphery of said cylindrical outer upright wall and curving smoothly outwardly upwards, said cylindrical outer upright wall having a plurality of openings spaced around the periphery below the top dents thereof above the connecting area between said outward flange and said cylindrical outer upright wall.

2. The ashtray as claimed in claim 1 wherein said cylindrical outer upright wall comprises a plurality of cylindrical, top-opened smoke-extinguishing troughs on the inside and suspending in the annular chamber between said cylindrical outer upright wall and said cylindrical intermediate upright wall into which burning cigarettes can be inserted to extinguish the smoke, each of said smoke-extinguishing troughs having a small circular bottom hole through which cigarette ash passes to the inside of the annular chamber between said cylindrical outer upright wall and said cylindrical intermediate upright wall.

* * * * *